US006821174B2

(12) United States Patent
Kaneko et al.

(10) Patent No.: US 6,821,174 B2
(45) Date of Patent: Nov. 23, 2004

(54) METHOD OF MANUFACTURING IMAGE DISPLAY APPARATUS

(75) Inventors: Tetsuya Kaneko, Kanagawa (JP); Kohei Nakata, Tokyo (JP); Toshihiko Miyazaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 09/960,744

(22) Filed: Sep. 24, 2001

(65) Prior Publication Data

US 2002/0039870 A1 Apr. 4, 2002

(30) Foreign Application Priority Data

Sep. 29, 2000 (JP) ..... 2000-298026
Sep. 18, 2001 (JP) ..... 2001-282550

(51) Int. Cl.[7] ..... H01J 9/44
(52) U.S. Cl. ..... 445/6; 445/24; 445/25
(58) Field of Search ..... 445/6, 24, 25

(56) References Cited

U.S. PATENT DOCUMENTS

| | | | | |
|---|---|---|---|---|
| 5,185,554 A | | 2/1993 | Nomura et al. | 313/495 |
| 5,209,687 A | | 5/1993 | Konishi | 445/6 |
| 5,591,061 A | * | 1/1997 | Ikeda et al. | 445/3 |
| 5,627,436 A | | 5/1997 | Suzuki et al. | 315/169.1 |
| 5,821,689 A | | 10/1998 | Andoh et al. | 313/495 |
| 5,828,352 A | | 10/1998 | Nomura et al. | 345/74 |
| 5,925,979 A | | 7/1999 | Azuma et al. | 313/495 |
| 6,011,567 A | | 1/2000 | Nakamura et al. | 347/115 |
| 6,149,480 A | * | 11/2000 | Iwasaki et al. | 445/6 |
| 6,254,449 B1 | * | 7/2001 | Nakanishi et al. | 445/25 |
| 6,416,374 B1 | * | 7/2002 | Mitome et al. | 445/6 |

FOREIGN PATENT DOCUMENTS

| | | | |
|---|---|---|---|
| EP | 0 767 481 | | 4/1997 |
| EP | 0 785 564 | | 7/1997 |
| EP | 0 803 892 | | 10/1997 |
| EP | 908916 | * | 4/1999 |
| JP | 4-249827 | | 9/1992 |
| JP | 8-96700 | | 4/1996 |
| JP | 11-135018 | | 5/1999 |
| JP | 4-11-135018 | * | 5/1999 |
| JP | 4-11-312467 | * | 11/1999 |
| JP | 2000-311596 | * | 11/2000 |

OTHER PUBLICATIONS

M. Hartwell, et al., "Strong Electron Emission From Patterned Tin–Indium Oxide Thin Films", International Electron Devices Meeting, pp. 519–521 (1975).

G. Dittmer, "Electrical Conduction and Electron Emission of Discontinuous Thin Films", Thin Solid Films, pp. 317–328 (1972).

C.A. Mead, "Operation of Tunnel–Emission Devices", Journal of Applied Physics, vol. 32, No. 4, pp. 646–652 (Apr. 1961).

(List continued on next page.)

*Primary Examiner*—Kenneth J. Ramsey
(74) *Attorney, Agent, or Firm*—Fitzpatrick, Cella, Harper & Scinto

(57) ABSTRACT

In a method of manufacturing an image display apparatus, a first member having an electron-emitting device and a second member having a phosphor which is irradiated with an electron emitted from the electron-emitting device to emit light are seal-bonded in a seal bonding chamber in which a vacuum atmosphere is realized. An aging step for the electron-emitting device is performed before the step of seal-bonding.

30 Claims, 4 Drawing Sheets

U.S. PATENT DOCUMENTS

C.A. Spindt, et al., "Physical Properties of Thin–Film Field Emission Cathodes with Molybdenum Cones", Journal of Applied Physics, vol. 47, No. 12, pp. 5248–5263 (Dec. 1976).

H. Araki, et al., "Electroforming and Electron Emission of Carbon Thin Films", pp. 22–29 (Jan. 26, 1983).

M.I. Elinson, et al., "The Emission of Hot Electrons and the Field Emission of Electrons From Tin Oxide", Radio Engineering and Electronic Physics, No. 7, pp. 1290–1296 (Jul. 1965).

W.P. Dyke, et al., "Field Emission", Advances in Electronics and Electron Physics, vol. VIII, pp. 89–185 (1956).

* cited by examiner

TEMPER-ATURE
ROOM TEMPER-ATURE
380°C
100°C
160°C
140°C
VACUUM DEGREE
ATMOS-PHERE
$10^{-5}$Pa
$10^{-4}$Pa
$10^{-5}$Pa
$10^{-6}$Pa

METHOD OF MANUFACTURING IMAGE DISPLAY APPARATUS

BACKGROUND OF THE INVENTION

1. Field of the Invention

The present invention relates to a method of manufacturing an image display apparatus and, more particularly, to a method of manufacturing an image display apparatus obtained by combining a member having electron-emitting devices and a member having a phosphor.

2. Related Background Art

Conventionally, two types of devices, namely thermionic and cold cathode devices, are generally known as electron-emitting devices. Known examples of the cold cathode devices are field emission type electron-emitting devices (to be referred to as FE type electron-emitting devices hereinafter), and metal/insulator/metal type electron-emitting devices (to be referred to as MIM type electron-emitting devices hereinafter).

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenum cones", J. Appl. Phys., 47, 5248 (1976).

A known example of the MIM type electron-emitting devices is described in C. A. Mead, "Operation of Tunnel Emission Devices", J. Appl. Phys., 32, 646 (1961).

A known example of surface-conduction emission type electron-emitting devices is described in, e.g., M. I. Elinson, "Radio Eng. Electron Phys., 10, 1290 (1965) and other examples will be described later.

The surface conduction electron-emitting device utilizes the phenomenon in which electrons are emitted by a small-area thin film formed on a substrate by flowing a current in parallel with the film surface. The surface conduction electron-emitting device includes electron-emitting devices using an $SnO_2$ thin film according to Elinson mentioned above, an Au thin film (G. Dittmer, "Thin Solid Films", 9,317 (1972)), an $In_2O_2/SnO_2$ thin film (M. Hartwell and C. G. Fonstad, "IEEE Trans. ED Conf.", 519 (1975)), a carbon thin film (Hisashi Araki et al., "Vacuum", Vol. 26, No. 1, p. 22 (1983)), and the like.

The image display apparatus using the above electron-emitting devices is manufactured by using the manufacturing process of preparing an electron source substrate (rear plate) on which these electron-emitting devices are arranged in a matrix, preparing a phosphor substrate (face plate) having a phosphor that is excited by electron beams to emit light, placing the face plate and rear plate to make them oppose each other such that the electron-emitting devices and phosphor are located inside, and an envelope for providing a sealed vacuum structure and a spacer for providing an atmospheric pressure resistant structure are arranged between the plates, sealing the interior by using a low-melting material such as frit glass as a seal bonding material, evacuating the interior through an exhaust pipe prepared in advance, and sealing the exhaust pipe, thereby manufacturing a display panel.

Conventional techniques are disclosed in Japanese Laid-Open Patent Application No. 11-135018, Japanese Laid-Open Patent Application No. 8-96700, EPA0767481, EPA0785564, EPA0803892, and Japanese Laid-Open Patent Application No. 4-249827.

It is desired in an image display apparatus using such electron-emitting devices to realize a high vacuum degree inside the panel.

SUMMARY OF THE INVENTION

The present inventors have, after intensive research and study, discovered that, in an image display apparatus using electron-emitting devices, there are some steps of the manufacturing steps affecting the atmosphere in the image display apparatus.

It is an object of the present invention to implement a manufacturing method capable of obtaining an image display apparatus having a good internal atmosphere even if the manufacturing steps include one of such steps.

According to the present invention, there is provided a method of manufacturing an image display apparatus, comprising a step of seal-bonding a first member having an electron-emitting device and a second member having a phosphor which is irradiated with an electron emitted from the electron-emitting device to emit light in a seal bonding chamber in which a vacuum atmosphere is realized, wherein a step of aging the electron-emitting device is performed before the step of seal-bonding.

Another aspect of the present invention has the following arrangement.

There is provided a method of manufacturing an image display apparatus, comprising a step of seal-bonding a first member having a plurality of electron-emitting devices and a second member having a phosphor which is irradiated with an electron emitted from the electron-emitting device to emit light in a seal bonding chamber in which a vacuum atmosphere is realized, wherein, before a step of seal-bonding, a characteristic adjustment step of selectively adjusting characteristics of the plurality of electron-emitting devices is performed.

Still another aspect of the present invention has the following arrangement.

There is provided a method of manufacturing an image display apparatus, comprising a step of seal-bonding a first member having an electron-emitting device and a second member having a phosphor which is irradiated with an electron emitted from the electron-emitting device to emit light in a seal bonding chamber in which a vacuum atmosphere is realized, wherein, before the step of seal-bonding, a voltage application step of applying a voltage to the electron-emitting device subjected to an activation step is performed.

Still another aspect of the present invention has the following feature.

There is provided a method of manufacturing an image display apparatus, comprising a step of seal-bonding a first member having an electron-emitting device and a second member having a phosphor which is irradiated with an electron emitted from the electron-emitting device to emit light in a seal bonding chamber in which a vacuum atmosphere is realized, wherein, before the step of seal-bonding, the voltage application step of applying a voltage to the electron-emitting device having carbon and/or a carbon compound at electron-emitting portion and/or near an electron-emitting portion.

Still another aspect of the present invention has the following feature.

There is provided a method of manufacturing an image display apparatus, comprising a step of seal-bonding a first member having an electron-emitting device and a second member having a phosphor which is irradiated with an electron emitted from the electron-emitting device to emit light in a seal bonding chamber in which a vacuum atmosphere is realized, wherein, before the step of seal-bonding, a voltage application step of applying a voltage to the electron-emitting device is performed, the voltage having a value larger than a normal driving voltage value applied to the electron-emitting device at image display operation.

DETAILED DESCRIPTION OF THE PREFERRED EMBODIMENTS

Figures 1A, 1B, 1C:
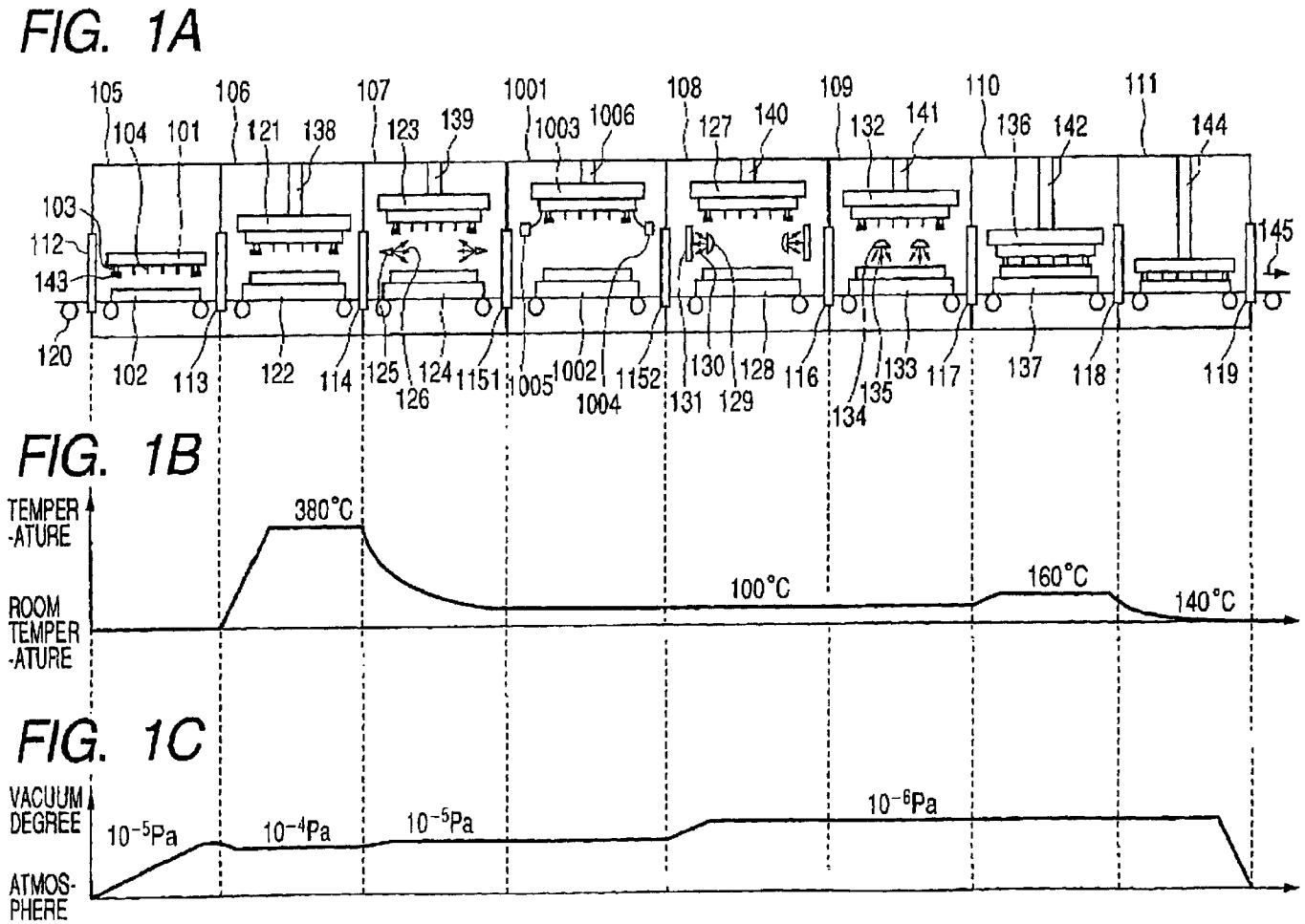
FIGS. 1A, 1B and 1C are views schematically showing a manufacturing apparatus according to the present invention, together with the temperature profile of each panel member in the manufacturing apparatus and a vacuum degree profile between the respective chambers in the manufacturing apparatus.

It is an object of the present invention to provide a manufacturing method capable of obtaining an image display apparatus having an excellent internal atmosphere.

One aspect of the present invention has the following arrangement.

There is provided a method of manufacturing an image display apparatus, comprising a step of seal-bonding a first member having an electron-emitting device and a second member having a phosphor which is irradiated with an electron emitted from the electron-emitting device to emit light in a seal bonding chamber in which a vacuum atmosphere is realized, wherein an aging step for the electron-emitting device is performed before the step of seal-bonding.

The present inventors have discovered that aging for electron-emitting devices is preferably performed in a high vacuum state (at a low pressure). However, the present inventors have also discovered that aging processing degrades a vacuum atmosphere.

On the basis of the above discoveries, the present inventors have attained an inventive technique of using the seal bonding step in a seal bonding chamber in which a vacuum atmosphere is realized and performing aging processing prior to the seal bonding step "Aging" according to the present invention is defined as a step of controlling electron emission characteristics, for example, by applying to an electron-emitting device a voltage higher than a voltage to be applied during a normal image display driving operation; by irradiating an electron-emitting portion with electrons having energy higher than that of electrons applied to the electron-emitting portion during the normal image display operation (a source for emitting electrons having this high energy is not limited to an electron-emitting device as a component of the image display apparatus, and may be an independent electron beam source that does not contribute to image display operation); or by irradiating an electron-emitting portion with UV. By performing this step preliminary, abrupt changes in characteristics in the subsequent steps, especially after driving operation for actual image display is started, can be suppressed. When the amount of emission current obtained by applying a predetermined voltage, in particular, (a voltage which is equal in magnitude to a voltage to be applied for actual image display operation and has a value in the range of voltage values to be applied for the actual image display operation) to an electron-emitting device after aging is smaller than the amount of emission current obtained by applying the predetermined voltage to the electron-emitting device before aging, an abrupt change in characteristics from the start of this driving operation (image display operation) can preferably be suppressed over a long period of time.

Another aspect of the present invention has the following feature.

There is provided a method of manufacturing an image display apparatus, comprising a step of seal-bonding a first member having a plurality of electron-emitting devices and a second member having a phosphor which is irradiated with an electron emitted from the electron-emitting device to emit light in a seal bonding chamber in which a vacuum atmosphere is realized wherein, before the step of seal-bonding, the characteristic adjustment step of selectively adjusting characteristics of the plurality of electron-emitting devices is performed.

The present inventors have discovered that the characteristics of electron-emitting devices are preferably adjusted in a high vacuum state (at a low pressure). However, the present inventors have found that characteristic adjustment processing affects a vacuum atmosphere.

On the basis of these findings, the present inventors have attained an inventive technique of performing the seal bonding step in a seal bonding chamber in which a vacuum atmosphere is realized, and performing characteristic adjustment processing before the seal bonding step.

In this case, to selectively adjust the characteristics of a plurality of electron-emitting devices is to adjust the characteristics of only a specific device or to vary the degrees of characteristic adjustment per each of the devices. "Characteristics" in this case means a relationship between the magnitude of an applied voltage and the emission current amount, and a relationship between the magnitude of an applied voltage and the amount of current flowing in the electron-emitting devices. Each aspect of the present invention can be suitably applied to a case where cold cathode devices are used, in particular. In a cold cathode device, electrons are emitted by applying a voltage between at least two electrodes. The above various characteristics can be adjusted by controlling the state in the gap portion between the two electrodes (more specifically, the length or material (crystal state or the like) of the gap portion). As a means for controlling the state of the gap portion, a structure for applying a voltage between the above two electrodes can be suitably used. In this case, characteristics can be selectively adjusted by applying a voltage to only a specific device or applying different voltages to the respective devices.

Still another aspect of the present invention has the following arrangement.

There is provided a method of manufacturing an image display apparatus, comprising a step of seal-bonding a first member having an electron-emitting device and a second member having a phosphor which is irradiated with an electron emitted from the electron-emitting device to emit light in a seal bonding chamber in which a vacuum atmosphere is realized, wherein, before the step of seal-bonding, the voltage application step of applying a voltage to the electron-emitting device subjected to the activation step is performed.

Still another aspect of the present invention has the following feature.

There is provided a method of manufacturing an image display apparatus, comprising a step of seal-bonding a first member having an electron-emitting device and a second member having a phosphor which is irradiated with an electron emitted from the electron-emitting device to emit light in a seal bonding chamber in which a vacuum atmosphere is realized, wherein, before the step of seal-bonding, a voltage application step of applying a voltage to the electron-emitting device having carbon and/or a carbon compound at electron-emitting portion and and/or near an electron-emitting portion is conducted.

The present inventors have discovered that an excellent image display apparatus can be obtained by applying a voltage to an electron-emitting device subjected to the activation step and/or an electron-emitting device having carbon and/or a carbon compound at electron-emitting portion and/or near an electron-emitting portions. The present inventors have also discovered that this voltage application is preferably performed in a high vacuum state (at a low pressure). However, the present inventors have discovered that the voltage application step affects a vacuum atmosphere.

On the basis of the above discoveries, the present inventors have attained an inventive technique of using the seal bonding step in a seal bonding chamber in which a vacuum atmosphere is realized, and performing the voltage application step prior to the seal bonding step. Note that "activation" in this case indicates the step of increasing the emission current amount when a voltage is applied to an electron-emitting device, in which the emission current amount obtained by applying a predetermined voltage to an electron-emitting device having undergone the activation step is larger than the emission current amount obtained by applying the predetermined voltage to the electron-emitting device before activation. Cold cathode devices, and more specifically, field-emission devices and surface conduction electron-emitting devices which are designed to emit electrons by applying a voltage between two electrodes can be activated by depositing a deposit on the gap portion between the two electrodes.

Still another aspect of the present invention has the following feature.

There is provided a method of manufacturing an image display apparatus, comprising the step of seal-bonding a first member having an electron-emitting device and a second member having a phosphor which is irradiated with an electron emitted from the electron-emitting device to emit light in a seal bonding chamber in which a vacuum atmosphere is realized, wherein before the step of seal-bonding, the voltage application step of applying, to the electron-emitting device, a voltage having a voltage value larger than a normal driving voltage value applied to the electron-emitting device in image display operation is performed.

In the present invention, after the aging step, characteristic adjustment step, or voltage application step is performed, the seal bonding step is preferably performed without exposing the electron-emitting device to an external atmosphere. More specifically, the present invention can use an arrangement for performing the aging or characteristic adjustment in the seal bonding chamber and an arrangement for transferring the electron-emitting device from the processing chamber for performing the aging, characteristic adjustment, or voltage application into the seal bonding chamber without exposing the device to the external atmosphere, as described in the embodiment to be described later. When the latter arrangement is to be used, these processing chambers are preferably coupled to the seal bonding chamber directly or through another depressurized (processing) chamber.

In addition, the aging step, characteristic adjustment step, or voltage application step is preferably performed in an atmosphere in which the material for a substance deposited on the electron-emitting portion of the electron-emitting device and/or near the electron-emitting portion is sufficiently small in a region where the electron-emitting device exists and deposition is suppressed. More specifically, such a step is preferably performed at a sufficiently low pressure. This step is preferably performed at a pressure of $1\times10^{-4}$ Pa or less, and more preferably, $1\times10^{-5}$ Pa or less. In addition, the above deposition noticeably originates from an organic substance in an atmosphere It is therefore preferable that the aging step, characteristic adjustment step, or voltage application step be performed in an atmosphere in which the partial pressure of an organic substance is $1\times10^{-6}$ Pa or less.

After the aging step, characteristic adjustment step, or voltage application step, the pressure in a region where the electron-emitting device exists is preferably kept at $1\times10^{-4}$ Pa or less, and more preferably $1\times10^{-5}$ Pa or less until an isolated space is formed between the first and second members. The "isolated space" in this case means a space that is not directly influenced by gas molecules in an external atmosphere. In the seal bonding step, the pressure in this area is preferably $1\times10^{-6}$ Pa or less. To substantially keep a specific vacuum degree state, i.e., $1\times10^{-4}$ Pa or less, and more preferably $1\times10^{-5}$ Pa or less as described above is to allow a temporary decrease in vacuum degree by getter flashes as in the following embodiment. Even if the vacuum degree temporarily decreases, since the vacuum degree quickly increases afterward, the substantial influence is suppressed to a negligible degree. Therefore, such a temporary decrease in vacuum degree is permitted.

The partial pressure of an organic substance in a region where an electron-emitting device exists is preferably kept low until the aging step, characteristic adjustment step, or voltage application step and seal bonding are completed. This pressure is preferably set to $1\times10^{-6}$ Pa or less. In the seal bonding step, the partial pressure of the organic substance in this region is preferably lower than $1\times10^{-6}$ Pa.

The aging step or characteristic adjustment step is preferably the step of applying a voltage to the electron-emitting device. Note that the voltage to be applied to the electron-emitting device before seal bonding, including the voltage application step, according to the present invention, is preferably higher than the-voltage to be generally applied to the electron-emitting device in image display operation. The aging step, characteristic adjustment step, or voltage application step is preferably the step of making the electron-emitting device emit electrons.

If the present invention has the step (panel getter step) of forming a getter on a member of an image display apparatus, and more specifically, a face plate or rear plate, the aging step, characteristic adjustment step, or voltage application step is preferably performed prior to the getter forming step. This is because the execution of the respective steps in this order can prevent the panel getter from reacting to the gas produced in the aging step, characteristic adjustment step, or voltage application step and wasting the ability of the getter during the manufacturing process.

If the present invention includes the electron beam cleaning step of cleaning a member, e.g., a face plate or rear plate, of an image display apparatus before the seal bonding step, the aging step, characteristic adjustment step, or voltage application step is preferably performed after this electron beam cleaning step. The electron beam cleaning step is preferably performed before the aging step, characteristic adjustment step, or voltage application step because the generation of a gas produced in the electron beam cleaning step may affect the characteristics of electron-emitting devices.

All the inventive techniques described above can be suitably applied to a case wherein the first member has a plurality of electron-emitting devices, in particular. The present invention is especially suitable for an arrangement having 100,000 or more electron-emitting devices as an arrangement for performing image display apparatus. In addition, it is especially preferable that electron-emitting devices be arranged in the row and column directions in the form of a matrix.

Seal bonding between the first and second members includes seal bonding between them through another member such as a frame member.

As electron-emitting devices in the present invention, cold cathode devices can be suitably used, as described above. Spindt type electron-emitting devices and surface conduction electron-emitting devices used in the following embodiment can be suitably used in particular.

FIG. 1A is a view schematically showing a manufacturing apparatus according to the present invention. FIG. 1B is a temperature profile indicating the temperature of the first or second member described above. FIG. 1C is a vacuum degree profile indicating the vacuum degree in the manufacturing apparatus. Examples of a manufacturing method and apparatus according to the present invention will be described below with reference to FIGS. 1A to 1C.

Referring to FIG. 1A, a rear plate (to be referred to as an RP hereinafter) 101 is a panel member, on which an electron source is formed, which has a plurality of electron-emitting devices as phosphor excitation means (surface conduction electron-emitting devices each having a graphite carbon film formed on an electron-emitting portion and its neighboring portion in the activation step) arranged along a plurality of row-directional wirings and a plurality of column-directional wirings by matrix wiring. A face plate (to be referred to as an FP hereinafter) 102 is a panel member, on which a phosphor, metal back, and the like are formed. An outer frame 103 serves as a panel member and is located between the RP 101 and the FP 102 to constitute a panel serving as an airtight container together with the RP 101 and the FP 102. A spacer 104 maintains the gap between the RP 101 and the FP 102. In this embodiment, FIG. 1A shows a case wherein the outer frame 103 and spacer 104 are arranged/fixed on the RP 101 in advance.

A preliminary chamber 105, baking chamber 106, surface cleaning chamber 107, energization chamber 1001 serving as an aging and characteristic adjusting chamber, first getter processing chamber (chamber getter processing chamber) 108, second getter processing chamber (panel getter processing chamber) 109, seal bonding chamber 110, and cooling chamber 111 are sequentially arrayed/connected in the transfer direction (an arrow 145 in FIG. 1A). Each chamber is evacuated by a vacuum pump (not shown) to form a vacuum atmosphere.

In this embodiment, the surface cleaning chamber 107 is an electron beam irradiation chamber (to be referred to as an EB irradiation chamber hereinafter) having an electron beam irradiation means. The atmosphere and the respective chambers are isolated from each other through gate valves 112, 113, 114, 115, 1152, 116, 117, 118, and 119. The RP 101, FP 102, outer frame 103, and spacer 104, which are panel members, are loaded into the chamber 105 by opening/closing the gate valve 112 and sequentially moved into the respective chambers by opening/closing the respective gate valves. Transfer rollers 120 serve to move the panel members into the respective chambers.

In addition, hot plates 121, 123, 1003, 127, 132, and 136 are used to heat the RP 101 and the outer frame 103 and spacer 104 which are fixed on the RP 101. Hot plates 122, 124, 1002, 128, 133, and 137 heat the FP 102.

Electron guns 125 emit electron beams in the EB irradiation chamber 107. Electron beams 126 are emitted from the electron guns 125.

Probes 1004 and 1005 come into electric contact with the two end portions of each of the row-directional wirings formed on the RP 101 to apply potentials thereto. In addition, probes (not shown) also come into electric contact with the end portions of the column-directional wirings formed on the RP 101 to apply potentials thereto.

The chamber getter processing chamber 108 incorporates chamber getter flash devices 129 which produce chamber getter flashes 130 by instantaneously evaporating a material such as Ba. Chamber getter plates 131, to which the chamber getter flashes 130 adhere, serve as chamber getters to perform evacuation. That is, the chamber getter plates can increase the vacuum degree in the chamber getter processing chamber 108.

In the panel getter processing chamber 109, panel getter flash devices 134 produce panel getter flashes 135 by instantaneously evaporating a material such as Ba. The flashes adhere to the FP 102. Thereafter, seal bonding is quickly performed for the panel in the seal bonding chamber 110. These panel getters serve to maintain the vacuum in the panel after panel seal bonding.

Elevators 138, 139, 1006, 140, 141, and 142 respectively support the hot plates 121, 123, 1003, 127, 132, and 136. Each elevator has the function of vertically moving the RP 101 to a level required in a corresponding step.

Referring to FIG. 1B, the abscissa represents the steps in the respective processing chambers in the manufacturing apparatus in FIG. 1A; and the ordinate, the temperature profile of the panel members in the steps in the respective chambers. This temperature profile indicates the temperature states of the RP 101 and FP 102. Referring to FIG. 1C, the abscissa represents the steps in the respective processing chambers in the manufacturing apparatus in FIG. 1A; and the ordinate, a vacuum degree profile in all the processing chambers.

The RP 101, FP 102, outer frame 103, and spacer 104 are driven by the transfer rollers 120 serving as transfer means to sequentially pass through the respective processing chambers in the direction indicated by the arrow 145 and undergo various types of processing while passing through the chambers.

Figure 3A:
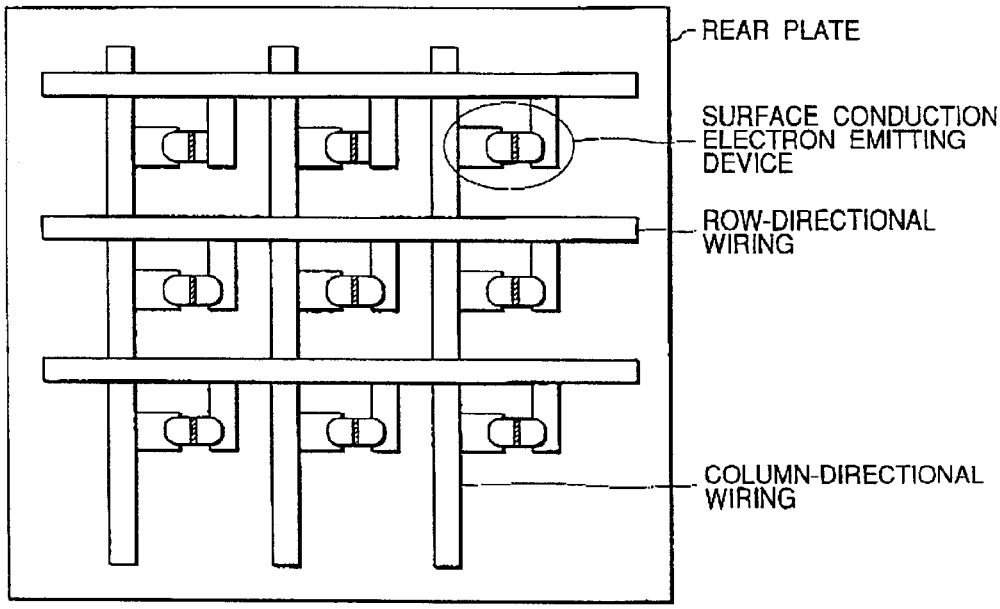
FIG. 3A is a plan view of a rear plate according to an embodiment of the present invention.
Figure 3B:
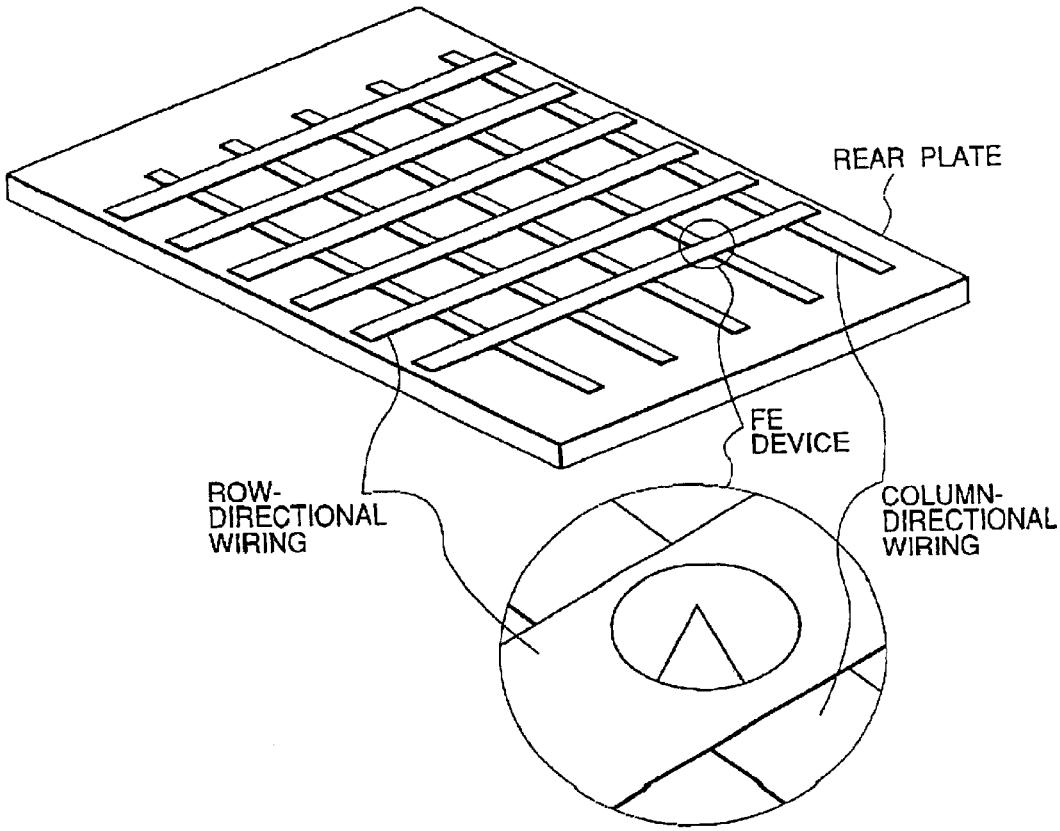
FIG. 3B shows schematically a matrix arrangement of FE devices on the rear plate.

In this embodiment, first of all, the first member constituted by the RP 101 having an electron source formed by connecting a plurality of electron-emitting devices in the form of a matrix through a plurality of row-directional wirings and a plurality of column-directional wirings, the outer frame 103, and the spacer 104 and the second member formed by the FP 102 on which a phosphor and metal back are arranged are prepared in the vacuum atmosphere of the preliminary chamber 105, and the following steps are performed along one line: bake processing in the baking chamber 106, an electron beam irradiation in the ED irradiation chamber 107, aging/characteristic adjustment processing in the energization chamber 1001, attainment of a high vacuum by chamber getter processing in the chamber getter processing chamber 108, deposition of a getter flash on the panel by panel getter processing in the panel getter processing chamber 109, heating seal bonding in the seal bonding chamber 110, and cool processing in the cooling chamber 111. FIG. 3A is a plan view of the RP 101 in this embodiment. As shown in FIG. 3B, the structure of the RP 101 can be applied to a unit having a plurality of FE devices arranged in the form of a matrix.

As described above, the gate valves 112, 113, 114, 1151, 1152, 116, 117, 118, and 119 are arranged between the respective processing chambers of the manufacturing apparatus shown in FIG. 1A, and each processing chamber is evacuated by an evacuation system (not shown). In this embodiment, the gate valves 112, 113, 114, 1151, 1152, 116, 117, 118, and 119 are arranged between the respective processing chambers. However, these gate valves are required to be arranged only between processing chambers that differ in their vacuum degrees in the vacuum profile shown in FIG. 1C and between a chamber and an atmosphere outside the apparatus. For example, the gate valves 116 and 117 between the chamber getter processing chamber 108, the panel getter processing chamber 109, and the seal bonding chamber 110 and the gate valve 1151 between the EB irradiation chamber 107 and the energization chamber 1001 can be omitted.

If there are no gate valves between the adjacent processing chambers and the panel member exhibits different temperatures in the respective steps unlike the above case, heat-insulating members (in the form of a plate, film, or the like) made of a reflective metal such as aluminum, chromium, or stainless steel are preferably arranged between the respective steps. Such a heat-insulating member is preferably placed between processing chambers in which the temperature profile of the panel member in FIG. 1B exhibits different temperatures, e.g., between the baking chamber 106 and the second getter processing chamber 109 or between the second getter processing chamber 109 and the seal bonding chamber 110. Alternatively, such heat-insulating members are preferably arranged between the above two pairs of processing chambers, or may be arranged between the respective processing chambers. The above heat-insulating members are installed so as not to interfere with the movement of the FP 102 and RP 101 mounted above between the respective processing chambers.

In this embodiment, the outer frame 103 for sealing a vacuum structure and the spacer 104 that forms an atmosphere pressure resistant structure are fixed to the RP 101 before it is loaded into the preliminary chamber 105. However, the present invention is not limited to this. For example, the spacer 104 may be fixed to the outer frame 103 in advance (for example, the two ends of each plate-like spacer 104 crossing the inside of the outer frame 103 are fixed to the outer frame 103), and the resultant member is mounted as a single constituent member in this apparatus independently of the RP 101 or FP 102. Each step is then performed, and the resultant member can be finally placed/fixed at a desired position as a component of the panel in the seal bonding step.

Referring to FIG. 1A, as a seal bonding material 143, a low-melting material such as frit glass, a low-melting metal such as indium, or its alloy may be applied in advance to a side end portion of the FP 102 of the outer frame 103 placed on the RP 101. The position of the seal bonding material 143 is not limited to this. The seal bonding material 143 may be applied to an upper portion of the FP 102 on which the outer frame 103 is fixed in contact. If the outer frame 103 is to be mounted as an independent single constituent member in this apparatus, the seal bonding material 143 may be applied to a side end portion of the RP 101 of the outer frame 103 and a side end portion of the FP 102. Alternatively, the seal bonding material 143 may be applied to upper portions of the RP 101 on which the outer frame 103 is fixed and an upper portion of the FP 102. The above seal bonding material 143 may be applied to one of the following portions: an end portion of the outer frame 103, an upper portion of the RP 101 on which an end portion of the outer frame 103 is fixed in contact, and an upper portion of the FP 102.

In the apparatus having the above arrangement, the steps of evacuating the panel and performing seal bonding will be described below. The following steps are performed when seal bonding is performed for one panel. If, however, a plurality of panels are to be continuously processed and seal-bonded, the processing times in the respective steps may differ from each other. A step with a long processing time may be divided into a plurality of steps to be processed in a plurality of processing chambers so as to adjust the long processing time to the processing times in the remaining steps. Alternatively, a plurality of constituent elements for processing, e.g., hot plates, are arranged in a single processing chamber to allow simultaneous processing.

First of all, the FP 102 and the RP 101 on which the outer frame 103 and spacer 104 are fixed in advance and to which the seal bonding material 143 is also applied in advance are loaded into the preliminary chamber 105. In loading them, the RP 101 and FP 102 are placed on a transfer jig to structurally form a gap between the two substrates. Note that the present invention is not limited to the use of a jig for loading and unloading. The substrates of the RP 101 and FP 102 may be directly transferred by using a support transfer unit on the apparatus body side.

When loading is complete, the gate valve 112 serving as an entrance is closed, and the preliminary chamber 105 is evacuated. During this period, each processing chamber after the baking chamber 106 is set to a predetermined vacuum degree and temperature profile. Subsequently, in transferring the substrates of the RP 101 and FP 102, the gate valves 113 and 119 between the respective processing chambers are sequentially opened and closed.

When the preliminary chamber 105 reaches an evacuated state on the order of $10^{-5}$, the gate valve 113 is opened, and the RP 101 and FP 102 are unloaded from the preliminary chamber 105 and moved into the baking chamber 106. After this movement, the gate valve 113 is closed.

The RP 101 and FP 102 moved into the baking chamber 106 without being exposed to the atmosphere are subjected to heating processing (bake processing) in the baking chamber 106. With this bake processing, impurities such as hydrogen, oxygen, and water contained and adsorbed in the RP 101 and FP 102 can be exhausted in gaseous forms. The bake processing temperature at this time is generally set to 300° C. to 400° C., and more preferably, 350° C. to 380° C. The vacuum degree at this time is about $10^{-4}$ Pa.

The RP 101 and FP 102 having undergone the bake processing is moved into the EB irradiation chamber 107, and the RP 101 is fixed on the hot plate 123 to be moved to an upper portion in the EB irradiation chamber 107 by the elevator 139. During this period, the RP 101 and FP 102 are temporarily separated from the hot plates 121 and 122 in the baking chamber 106 which serve as heat sources. To prevent an abrupt drop in temperature, however, the RP 101 and FP 102 are fixed to the hot plates 123 and 124 in the EB irradiation chamber 107 and heated to gradually lower the temperatures of the RP 101 and FP 102. In this substrate temperature range with a decrease in temperature, the EB 126 is output from the electron gun 125 to an arbitrary area to perform EB irradiation processing (electron beam cleaning). In general, EB irradiation processing is performed in a substrate temperature range of 100° C. to the bake processing temperature. At this time, the vacuum degree ranges from about $10^{-4}$ Pa to $10^{-5}$ Pa.

The EB irradiation processing has the effect of cleaning the substrates by gas desorption of adsorbed impurities upon irradiation of the RP 101 and FP 102 with electron beams. In addition, as described above, in this case, the heat inertia in the bake processing can be used, the cleaning effect is further enhanced. The EB irradiation processing may be performed both the RP 101 and FP 102 or one of them.

The EB irradiation processing is not limited to the RP 101 and FP 102 and may be performed in an arbitrary region in the EB irradiation chamber. In addition to the substrate cleaning effect, the EB irradiation processing has the effect of promoting adsorption of the gases desorbed by baking and EB irradiation substrate cleaning into the getter in the getter flash processing as post-processing by performing EB irradiation in the chamber space.

The above EB irradiation chamber 107 or the EB irradiation chamber 107 and the first getter processing chamber 108 (chamber getter processing chamber) to be described later serve as slow cooling chambers for cooling the RP 101 and FP 102 having undergone the bake processing. According to a preferred embodiment, a slow cooling chamber may be independently installed between the baking chamber 106 and the EB irradiation chamber 107.

In such a slow cooling chamber, the RP 101 and FP 102 are fixed on hot plates to prevent an abrupt drop in temperature from the heating temperature in the bake processing, thus gradually cooling the substrates. The temperature ranges of the hot plates at this time are set within the range of 100° C. to the bake processing temperature, and the vacuum degree is set within the range of about $10^{-4}$ Pa to $10^{-5}$ Pa.

After the EB irradiation processing, the elevator 139 is lowered, and the RP 101 is removed from the hot plate 123 and moved into the energization chamber 1001, together with the FP 102. At this time, the RP 101 and FP 102 are moved into the energization chamber 1001 without being exposed to the atmosphere. In the energization chamber 1001, the RP 101 is raised while being held on the hot plate 1003. Thereafter, the row-directional wiring probes 1004 and 1005 and column-directional wiring probes are brought into electric contact with end portions of the row- and column-directional wirings formed on the RP 101.

At this time, a voltage as the difference between potentials applied to row-directional wirings and column-direction wirings by the row- and column-direction wiring probes is applied to a predetermined device. More specifically, a potential of −7.5 V is applied to one of the row-directional wirings, and a potential of 0 V is applied to the remaining row-directional wirings. A potential of +7 V is applied to all the column-direction wirings. As a consequence, a voltage of 14.5 V which is the difference between the potentials applied to the row- and column-direction wirings is applied to the electron-emitting device connected to the row-directional wiring to which a potential of −7.5 V is applied, thereby promoting aging of the device. At this time, since a voltage of 7 V is applied to the devices connected to the remaining row-directional wirings, aging is not promoted. Thereafter, all the electron-emitting devices are made to experience a voltage of 14.5 V while the row-directional wiring to which a potential of −7.5 V is applied is sequentially changed. Aging processing is performed by repeating this process, as needed. In this embodiment, a pulse-like voltage is applied to each electron-emitting device in this embodiment. This voltage has a pulse width of 66.8 (ps) and a pulse period Ts of 16.6 (ms). 100 pulses each having a voltage of 14.5 V are applied to each device.

"Aging" in the present invention is the step of controlling electron emission characteristics by, for example, applying a voltage higher than a voltage to be applied for image display driving operation to an electron-emitting device, irradiating an electron-emitting portion with electrons having energy higher than that of electrons applied to the electron-emitting portion in image display operation (a source for emitting electrons having this high energy is not limited to an electron-emitting device as a component of the image display apparatus, and may be an independent electron beam source that does not contribute to image display operation), or irradiating an electron-emitting portion with UV. Note that in the aging step in this embodiment, the amount of emission current obtained by applying a predetermined voltage (a voltage which is equal in magnitude to a voltage to be applied for actual image display operation and has a value in the range of voltage values to be applied for the actual image display operation) to an electron-emitting device after aging is smaller than the amount of emission current obtained by applying the predetermined voltage to the electron-emitting device before aging. An abrupt change in characteristics from the start of driving operation (actual image display operation) can be suppressed over a long period of time.

In many cases, the electron emission characteristics of the respective devices, i.e., the characteristics associated with the amounts of current (device current) flowing in devices with respect to applied voltages, cannot be matched by aging processing alone. In this embodiment, therefore, a voltage is selectively applied to a device that produces a larger device current amount than the remaining devices upon application of a voltage of 14 V (equal to the voltage to be applied for actual image display operation), thereby adjusting characteristics. More specifically, in the above aging processing, potentials for aging are applied to all the column-direction wirings. In contrast to this, in this selective characteristic adjusting step, a pulse potential is applied to a column-direction wiring to which a device to which a characteristic adjustment voltage should be applied is connected while the pulse potential is gradually increased in the positive direction, and a potential of 0 V is applied to a column-direction wiring to which devices to which no characteristic adjustment voltage should be applied are connected. With this operation, a voltage which gradually increases is applied to a specific device. Note that this voltage is equal in pulse width and pulse period to that used in the above aging processing. Note that a current flowing in the column-direction wiring at the same time a pulse voltage is applied is monitored, and characteristic adjustment for the device is completed when the monitored current value becomes equal to the predetermined value. In order to select a device subjected to characteristic adjustment, a potential of −7.5 V is applied to only a row-directional wiring to which an electron-emitting device subjected to characteristic adjustment, and a potential of 0 V is applied to the remaining row-directional wirings. A mechanism for allowing such voltage applying steps, e.g., the aging step and characteristic adjustment step, to reduce the amount of electrons emitted from an electron-emitting device has not been fully elucidated. The present inventors have found that at least in a device having carbon and a carbon compound near an electron-emitting portion, the amount of emission current can be reduced by performing voltage application steps such as the aging step and characteristic adjustment step in a vacuum atmosphere, and more preferably, an atmosphere in which the partial pressure of an organic substance is low, before normal display driving of the image display apparatus. The present inventors have also found that in a surface conduction electron emitting device having carbon and a carbon compound near the electron-emitting portion in an activation step, in particular, the amount of emission current can be reduced by setting a voltage value in this voltage application step to be larger than the voltage value in display driving operation.

Note that in this aging step, characteristic adjustment step, and voltage application step, evacuation is performed by using a vacuum pump to maintain a vacuum atmosphere. The partial pressure of an organic substance is maintained at $1\times10^{-6}$ Pa or less.

Note that the electron source manufactured in this embodiment is designed to perform pulse width modulation when it is actually driven after the manufacturing process, and a voltage of 14 V is used as a driving voltage to be applied to each device to perform actual image display operation.

After the energization processing is complete and the elevator 1006 is lowered, the RP 101 is removed from the hot plate 1003 and moved into the chamber getter processing chamber 108, together with the FP 102. At this time, the RP 101 and FP 102 are moved into the chamber getter processing chamber 108 without being exposed to the atmosphere. An evaporating getter material (a getter material such as barium) stored in the chamber getter flash device 129 is heated/evaporated by resistance heating or the like to generate the chamber getter flashes 130, thereby coating the surfaces of the chamber getter plates 131 arranged in the chamber, other than the panel members, with a getter film (not shown) formed by a barium film or the like. In this case, the thickness of each panel getter is generally 5 nm to 500 nm, preferably 10 nm to 200 nm, and more preferably 20 nm to 200 nm. With this chamber getter step, the getter film formed on each chamber getter plate 131 adsorbs/exhausts the gas in the chamber. As a consequence, the vacuum degree in the chamber getter processing chamber reaches the order of $10^{-6}$ Pa. This processing is performed while the substrate temperatures of the RP 101 and FP 102 are maintained in the temperature range of the baking temperature to 100° C. Note that since the getter material is evaporated to produce the chamber getter flashes 130, the vacuum degree in the chamber temporarily decreases but increases to a high vacuum by evacuation.

The RP 101 and FP 102 are then moved into the panel getter processing chamber 109, and the RP 101 is fixed on the hot plate 132 and moved to an upper portion in the panel getter processing chamber 109 by the elevator 141. The panel getter processing chamber has been evacuated to the order of $10^{-6}$ Pa. To attain this vacuum degree, in addition to the use of a general vacuum pump, an auxiliary evacuation means, e.g., exhaustion by flashes produced from an evaporating getter material or exhaustion by heating activation of a non-evaporating getter material, can be used. The above evacuation method of attaining the order of $10^{-6}$ Pa can also be applied to the seal bonding chamber 110 and cooling chamber 111 to be described later.

In the panel getter processing chamber 109, the evaporating getter material (a getter material such as barium) stored in the panel getter flash device 134 is heated/evaporated by resistance heating or the like to generate the panel getter flashes 135 to coat the surface of the FP with a getter film (not shown) formed by a barium film. At this time, the film thickness of the panel getter is generally 5 nm to 500 nm, preferably 10 nm to 200 nm, and more preferably 20 nm to 200 nm. The evaporating getter film formed in this processing step is not very susceptible to deterioration due to gas adsorption because a high vacuum of $10^{-5}$ Pa is set in the chamber used in this step. Therefore, this getter film is moved to the next seal bonding step while sufficiently high getter evacuation capability is maintained.

Referring to FIG. 1A, the getter film is formed on the FP 102. However, the member on which this film is formed is not limited to this and can be formed on the RP 101 or the like. However, a getter material is conductive in general, a large leakage current may be produced when the seal-bonded panel is driven to display an image or a breakdown voltage for a driving voltage cannot be maintained. If, for example, panel getter flashes are generated for the RP 101 in FIG. 1A, since conductive getter films are also formed on the outer frame 103 and spacer 104, a problem may arise in term of electricity in driving operation. In such a case, a portion on which a getter film should not be formed may be covered with a thin metal film mask to prevent a getter film from being formed and allow a getter film to be formed on only a necessary portion of the RP 101. Note that since the getter material is evaporated to produce panel getter flashes, the vacuum degree in the chamber temporarily decreases but increases to a high vacuum by evacuation.

After the panel getter step is complete and the elevator 141 is lowered, the RP 101 is removed from the hot plate 132 and moved into the chamber getter processing chamber 108, together with the FP 102.

The RP 101 and FP 102 are then moved into the seal bonding chamber 110 which has been evacuated to the order of $10^{-6}$ Pa and respectively fixed on the hot plates 136 and 137. At this time, the seal bonding material 143 on the outer frame 103 fixed on the RP 101 and the spacer 104 do not come into contact with the FP 102 and are fixed with a slight gap ensured therebetween. At the time of this fixing operation, the relative positions of the RP 101 and FP 102 in panel seal bonding are determined. The relative positions can be determined by the end standard using abutment pins. However, the present invention is not limited to this.

After this step, while the elevator 142 is lowered to make the outer frame 103 fixed on the RP 101 come into contact with the FP 102 and press it, the substrate is heated up to a seal bonding temperature suitable for the seal bonding material 143 as indicated by the temperature profile in FIG. 1B. With this operation, the seal bonding material 143 is softened and melted and held at the peak temperature for 10 min. Thereafter, the substrate temperature is lowered to fix the seal bonding material. With this operation, after the seal bonding material 143 formed on the outer frame 103 is softened and melted to bond the outer frame 103 to the FP 102, the seal bonding material 143 hardens and is fixed. At this time, the vacuum degree in the seal bonding chamber 110 is maintained at $10^{-6}$ Pa, and hence the vacuum degree in the panel seal-bonded in this step also becomes $10^{-6}$ Pa. The bonding/fixing temperature of the seal bonding material 143 is set as follows. If this material is indium metal, the heating peak temperature is set to 160° C., and the hardening/fixing temperature is set to 140° C. If the seal bonding material 143 is frit glass, the heating peak temperature is set to 390° C., and the hardening/fixing temperature is set to 300° C. Although the temperature rise rate for heating is set to 20° C./min, and the temperature fall rate is set to 5° C./min. The present invention is not limited to this. In addition, the heating peak temperature and hardening/fixing temperature are not limited to the above temperatures.

When the temperature drops to the hardening/fixing temperature or lower, the seal bonding processing is completed. Thereafter, the RP 101 is removed from the hot plate 136, and the elevator 142 is raised. The FP 102 is removed from the hot plate 137, and the seal-bonded panel 144 constituted by the RP 101, FP 102, outer frame 103, and spacer 104 is moved into the cooling chamber 111. At this time, the cooling chamber 111 is evacuated to the order of $10^{-6}$ Pa to maintain the vacuum degree in the seal bonding chamber. The seal-bonded panel 144 is removed from the hot plate at the hardening/fixing temperature of the seal bonding material and is cooled in the cooling chamber 111. As a cooling means, a cooling plate having the temperature control function using a water cooling means or the like is used. However, the present invention is not limited to this. Natural cooling may be performed in the cooling chamber 111 as long as no substrate damage is caused by an abrupt drop in the temperature of the seal-bonded panel 144.

When the temperature of the seal-bonded panel 144 drops to room temperature or a temperature near room temperature, vacuum leakage is performed in the cooling chamber 111 to set the processing chamber to the atmospheric pressure. Thereafter, the gate valve 119 on the atmosphere side outside the apparatus is opened to transfer the seal-bonded panel 144 outside the apparatus.

The manufacturing apparatus of this embodiment has the gate valve 118 between the seal bonding chamber 110 and the cooling chamber 111. The display panel is unloaded from the seal bonding chamber 110 while this gate valve is open. After the panel is loaded into the cooling chamber 111, the gate valve is closed. After slow cooling, the unloading port 119 is opened to unload the display panel from the cooling chamber 111. Finally, the unloading port 119 is closed, and all the processing steps are completed. A vacuum state is preferably set in the cooling chamber 111 by using an independent evacuation system (not shown) before the next processing step is started.

In this embodiment, in addition to the above evaporating getter material, a non-evaporating getter film or non-evaporating getter member may be prepared on the RP 101 or FP 102.

As the hot plates 121, 123, 1003, 127, 132, and 136, mechanical parts capable of fixing the RP 101 with a force large enough to prevent it from slipping off, e.g., mechanical parts using the chuck scheme using pawls that mechanically grip the peripheral portion of the substrate, the electrostatic chuck scheme, or the vacuum chuck scheme.

The above case is a combination of steps, and the structures of the processing chambers are variously modified in accordance with combinations of steps. In any of the structures, the aging step, characteristic adjustment step, and voltage application step are preferably performed before the panel getter step. This is because the execution of the respective steps in this order can prevent the panel getter from reacting to the gas produced in the aging step, characteristic adjustment step, or voltage application step and consuming the ability of the getter during the manufacturing process.

When the cleaning step is performed by electron beam cleaning, the aging step, characteristic adjustment step, or voltage application step is preferably performed after this electron beam cleaning step. The electron beam cleaning step is preferably performed before the aging step, characteristic adjustment step, or voltage application step because the generation of a gas produced in the electron beam cleaning step may affect the characteristics of electron-emitting devices. According to the first modification of the above processing steps, the respective processing chambers are arranged in a line to sequentially proceed with preparation of substrates in a vacuum atmosphere in the preliminary chamber 105, energization processing in the energization chamber 1001, panel getter processing in the panel getter processing chamber 109, heating seal bonding in the seal bonding chamber 110, and cool processing in the cooling chamber 111.

According to the second modification, the respective processing chambers are arranged in a line to sequentially proceed with preparation of substrates in a vacuum atmosphere in the preliminary chamber 105, bake processing in the baking chamber 106, energization processing in the energization chamber 1001, panel getter processing in the panel getter processing chamber 109, heating seal bonding in the seal bonding chamber 110, and cool processing in the cooling chamber. 111.

According to the third modification, the respective processing chambers are arranged in a line to sequentially proceed with preparation of substrates in a vacuum atmosphere in the preliminary chamber 105, a bake processing in the baking chamber 106, energization processing in the energization chamber 1001, chamber getter processing in the chamber getter processing chamber 108, panel getter processing in the panel getter processing chamber 109, heating seal bonding in the seal bonding chamber 110, and cool processing in the cooling chamber 111.

According to the fourth modification, the respective processing chambers are arranged in a line to sequentially proceed with preparation of substrates in a vacuum atmosphere in the preliminary chamber 105, EB irradiation processing in the EB irradiation chamber 107, energization processing in the energization chamber 1001, channel getter processing in the channel getter processing chamber 108, heating seal bonding in the seal bonding chamber 110, and cool processing in the cooling chamber 111.

As a modification of the transfer of the RP 101, FP 102, outer frame 103, and spacer 104 as constituent members and mounting of them in the apparatus, according to the fifth modification, the RP 101, the FP 102, and the spacer 104 fixed on the outer frame 103 can be mounted as three constituent members in the apparatus. In this case, since two surfaces of the RP 101 and FP 102 are required as seal bonding surfaces used for seal bonding processing for the outer frame 103 in the apparatus, a seal bonding material must be formed in advance for the respective seal bonding surfaces.

According to the sixth modification, the RP 101, the outer frame 103 bonded/fixed to the FP 102, and the spacer 104 bonded/fixed to the FP 102 can be mounted as two constituent elements in the apparatus. In this case, since a side surface of the RP 101 becomes a seal bonding surface for seal bonding processing for the outer frame 103 in the apparatus, a seal bonding material must be formed in advance on the seal bonding surface.

In contrast to the above modifications of the constituent members, as a modification of the apparatus structure in which the processing chambers of the apparatus are arranged in a line to merge all the constituent members in one processing chamber in the seal bonding step to perform seal bonding processing, according to the seventh modification, the RP 101, the FP 102, and the spacer 104 fixed on the outer frame 103 are handled as three constituent members, and the respective processing chambers between the preliminary chamber 105 and the panel getter processing chamber 109 are arranged in three lines. The above three constituent members are separately mounted in the apparatus. The three panel getter processing chambers are connected to be merged into one seal bonding chamber, and the three constituent members are seal-bonded in the seal bonding chamber. Thereafter, cool processing is performed.

According to the eighth modification, the outer frame 103 bonded/fixed on the RP 101, the spacer 104 bonded/fixed on the RP 101, and the FP 102 are handed as two constituent members, or the RP 101, the outer frame 103 bonded/fixed on the FP 1021, and the spacer 104 bonded/fixed on the FP 102 are handed as two constituent members, and the respective processing chambers between the preliminary chamber 105 and the panel getter processing chamber 109 are arranged in two lines. The above two constituent members are separately mounted in the apparatus, and the two panel getter processing chambers are connected to be merged into one seal bonding chamber. In the seal bonding chamber, the two constituent members are seal-bonded, and cool processing is performed.

The steps in the respective process lines in the seventh and eight modifications may be combined with the steps in the first, second, third, and fourth modifications.

According to the description of the above embodiment, the vacuum degree in seal bonding for the panel is set to the order of $10^{-6}$ Pa. However, the present invention is not limited to this. The vacuum degree in seal bonding for the panel may be set to the order of $10^{-5}$ Pa that can be generally attained by a vacuum pump. In this case, the chamber getter processing chamber 140 and the getter step which is performed to increase the attained vacuum degree in the processing chamber can be omitted. In addition, evacuation by an auxiliary getter pump for attaining $10^{-6}$ Pa can also be omitted.

The seal-bonded panel 144 having undergone the above steps has the following structural characteristic. Although an evaporating getter material film is formed on the FP, gettering of producing getter flashes mainly by high-frequency heating as an evaporation source for an evaporating getter material or a getter line for producing getter flashes mainly by resistance heating do not remain in the seal-bonded panel.

The above steps and apparatus are characterized in that the panel getter flash step and consecutive seal bonding step are performed in different processing chambers.

Figure 2:
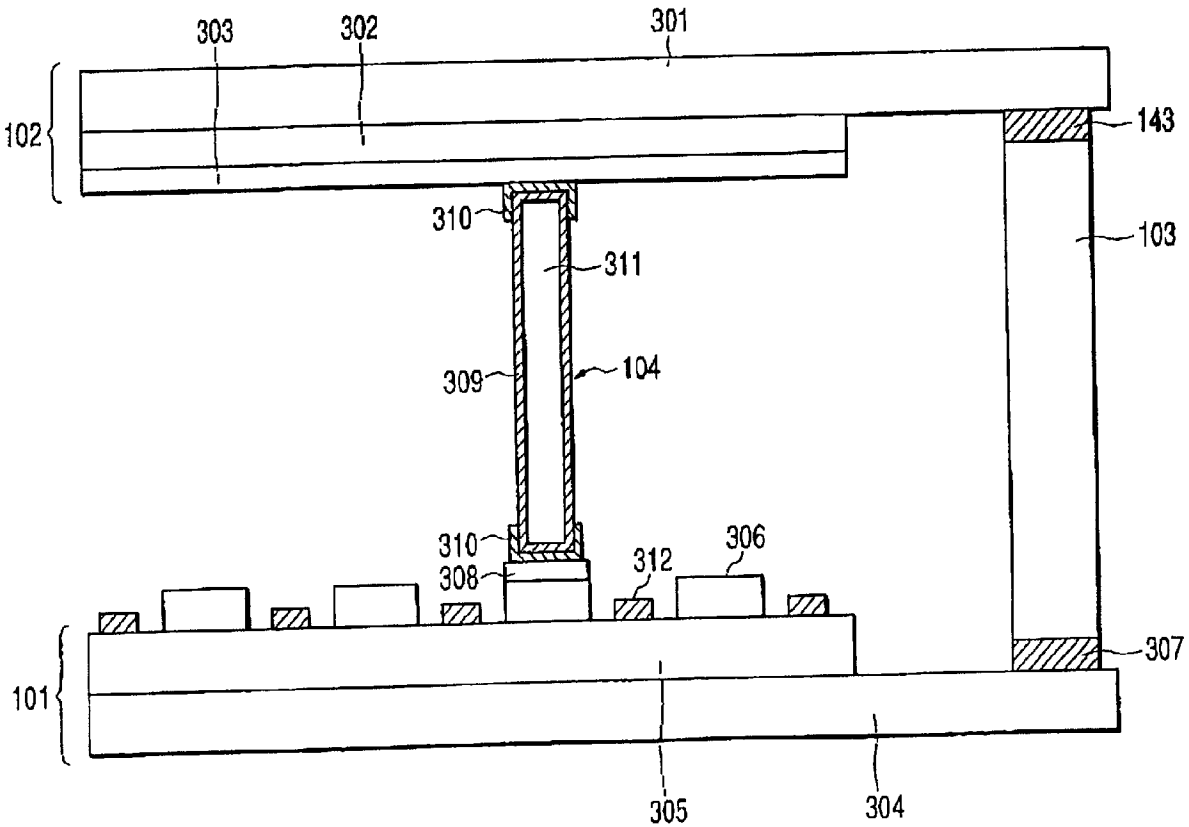
FIG. 2 is a sectional view showing part of an image display apparatus manufactured by using the manufacturing method and apparatus according to the present invention.

FIG. 2 is a sectional view of part of the image display apparatus manufactured by using the manufacturing method and apparatus according to this embodiment.

The same reference numerals as in FIG. 1 denote the same members in FIG. 2. In the image display apparatus manufactured by the above method and apparatus, a vacuum vessel or depressurized vessel is formed by the RP 101, FP 102, and outer frame 103.

The vacuum vessel can be set to a high vacuum degree of $10^{-5}$ Pa or more, and preferably $10^{-6}$ Pa or more.

The spacer 104 is placed in the above vacuum vessel or depressurized vessel to form an atmosphere pressure resistant structure. The spacer 104 used in the present invention has a main body 311 made of a alkali-free insulating material such as alkali-free glass, a high-resistance film 309 formed by a high-resistance material to cover the surface of the main body 311, and metal (tungsten, copper, silver, gold, molybdenum, or an alloy of these metals) film 310, and is electrically connected/boded on a wiring 306 through a conductive adhesive 308. The spacer 104 is bonded/fixed to the RP 101 with the adhesive 308 before the RP 101 is loaded into the preliminary chamber 105. When the processing in the seal bonding chamber is completed, the other end portion of the spacer 104 is electrically connected to the FP 102 in contact.

The RP 101 is comprised of a transparent substrate 304 made of glass or the like, an underlying film ($SiO_2$, $SnO_2$, or the like) 305 for preventing the entry of an alkali such as sodium, and a plurality of electron-emitting devices 312 arranged in the form of an XY matrix. A wiring 306 forms one cathode-side wiring of the cathode-side XY matrix wirings connected to electron-emitting devices.

On the FP 102, a transparent substrate 301, a phosphor layer 302, and an anode metal (aluminum, silver, copper, or the like) film 303 connected to an anode source (not shown) are arranged.

An envelope 113 is bonded/fixed on the RP 101 with a low-melting adhesive 307 such as frit glass before the RP 101 is loaded into the preliminary chamber 105. In the step performed in the seal bonding chamber 110, the envelope 113 is fixed/bonded with the seal bonding material 143 using indium or frit glass.

According to the above embodiment, in manufacturing an image display apparatus by forming more than 1,000,000 electron-emitting devices or plasma generating devices in the X and Y directions to have a large capacity, and mounting these large-capacity pixels on a 30-inch diagonal large screen, the manufacturing process time could be greatly shortened, and a high vacuum degree of $10^{-6}$ Pa could be attained in a vacuum vessel as a component of the image display apparatus.

In addition, in the above embodiment, after the aging step for electron-emitting devices, the characteristic adjustment step, and the like (particularly, the voltage application step in a high vacuum state) were performed, an image display apparatus having a high vacuum degree after seal bonding could be realized.

According to the present invention, an image display apparatus can be realized, in which changes in electron emission characteristics are suppressed and/or the electron-emitting characteristics exhibit high uniformity, and the vacuum degree is high.

What is claimed is:

1. A method of manufacturing an image display apparatus comprising a first member having an electron-emitting device and a second member having a phosphor which is irradiated with an electron emitted from the electron-emitting device to emit light and an anode to which a first voltage higher than a second voltage applied to the electron-emitting device is applied, said method comprising the steps of:

seal-bonding the first and second members in a seal bonding chamber in which a vacuum atmosphere is realized; and performing an aging step for aging the electron-emitting device without applying the first voltage to the anode before the step of seal-bonding.

2. A method according to claim 1, wherein, after the aging step is performed, without exposing the electron-emitting device to an external environment, the step of seal-bonding is performed.

3. A method according to claim 1, wherein the aging step is performed under a condition that a pressure of not more than $1\times10^{-4}$ Pa is set in a region where the electron-emitting device exists.

4. A method according to claim 3, wherein, after the aging step is performed, a pressure of substantially not more than $1\times10^{-4}$ Pa is maintained in the region where the electron-emitting device exists until an isolated space is formed between the first and second members in the seal bonding step.

5. A method according to claim 1, wherein the aging step is performed while a partial pressure of an organic substance in the region where the electron-emitting device exists is set at not more than $1\times10^{-6}$ Pa.

6. A method according to claim 5, wherein, after the aging step is performed, a partial pressure of an organic substance in the region where the electron-emitting device exists is maintained at substantially not more than $1\times10^{-6}$ Pa until an isolated space is performed between the first and second members in the seal bonding step.

7. A method according to claim 1, wherein the aging step comprises the step of applying a voltage to the electron-emitting device.

8. A method according to claim 7, wherein, in the step of applying the voltage, a value of the voltage is larger than a normal driving voltage value applied to the electron-emitting device at an image display operation.

9. A method according to claim 7, wherein the aging step comprises the step of causing the electron-emitting device to emit an electron.

10. A method of manufacturing an image display apparatus comprising a first member having an electron-emitting device and a second member having a phosphor which is irradiated with an electron emitted from the electron-emitting device to emit light, said method comprising:

a step of seal-bonding the first and second members in a seal bonding chamber in which a vacuum atmosphere is realized, wherein a step for aging the electron-emitting device is performed before the step of seal-bonding, and further comprising a panel getter step performed between the aging step and the seal-bonding step.

11. A method of manufacturing an image display apparatus comprising a first member having an electron-emitting device and a second member having a phosphor which is irradiated with an electron emitted from the electron-emitting device to emit light, said method comprising:

a step of seal-bonding the first and second members in a seal bonding chamber in which a vacuum atmosphere is realized, wherein a step for aging the electron-emitting device is performed before the step of seal-bonding, and further comprising an electron beam cleaning step conducted before the aging step.

12. A method of manufacturing an image display apparatus comprising a first member having a plurality of electron-emitting devices and a second member having a phosphor which is irradiated with an electron emitted from the electron-emitting devices to emit light and an anode to which a first voltage higher than a second voltage applied to the electron-emitting devices is applied, said method comprising the steps of:

seal-bonding the first and second members in a seal bonding chamber in which a vacuum atmosphere is realized; and before the seal-bonding step, performing a characteristic adjustment step of selectively adjusting characteristics of the plurality of electron-emitting devices without applying the first voltage to the anode.

13. A method according to claim 12, wherein, after the characteristic adjustment step is performed, without exposing the electron-emitting device to the atmosphere, the step of seal-bonding is performed.

14. A method according to claim 12, wherein the characteristic adjustment step is performed under a condition that while a partial pressure of an organic substance in the region where the electron-emitting device exists is set at not more than $1\times10^{-6}$ Pa.

15. A method according to claim 12, wherein, the characteristic adjustment step comprises the step of applying a voltage to the electron-emitting device.

16. A method according to claim 15, wherein in the step of applying the voltage, a value of the voltage is larger than a normal driving voltage value applied to the electron-emitting device at an image display operation.

17. A method according to claim 15, wherein the characteristic adjustment step comprises the step of causing the electron-emitting device to emit an electron.

18. A method of manufacturing an image display apparatus comprising a first member having a plurality of electron-emitting devices and a second member having a phosphor which is irradiated with an electron emitted from the electron-emitting devices to emit light, said method comprising:

a step of seal-bonding the first and second members in a seal bonding chamber in which a vacuum atmosphere is realized, wherein, before the step of seal-bonding, the characteristic adjustment step of selectively adjusting characteristics of the plurality of electron-emitting device is performed, and further comprising a panel getter step performed between the characteristic adjustment step and the seal-bonding step.

19. A method of manufacturing an image display apparatus comprising a first member having a plurality of electron-emitting devices and a second member having a phosphor which is irradiated with an electron emitted from the electron-emitting devices to emit light, said method comprising:

a step of seal-bonding the first and second members in a seal bonding chamber in which a vacuum atmosphere is realized, wherein, before the step of seal-bonding, the characteristic adjustment step of selectively adjusting characteristics of the plurality of electron-emitting device is performed, and further comprising an electron beam cleaning step performed before the characteristic adjustment step.

20. A method of manufacturing an image display apparatus comprising a first member having an electron-emitting device subjected to an activation process and a second member having a phosphor which is irradiated with an electron emitted from the electron-emitting device and an anode to which a first voltage higher than a second voltage applied to the electron emitting device is applied to emit light, said method comprising the steps of:

seal-bonding the first and second members in a seal bonding chamber in which a vacuum atmosphere is realized; and before the step of seal-bonding, performing a voltage application step of applying a voltage to the electron-emitting device subjected to the activation process without applying the first voltage to the anode.

21. A method of manufacturing an image display apparatus comprising a first member having an electron-emitting device having a carbon and/or carbon compound at and/or near an electron-emitting portion and a second member having a phosphor which is irradiated with an electron emitted from the electron-emitting device to emit light and an anode to which a first voltage higher than a second voltage applied to the electron-emitting device is applied, said method comprising the steps of:

seal-bonding the first and second members in a seal bonding chamber in which a vacuum atmosphere is realized; and before the step of seal-bonding, performing a voltage application step of applying a voltage to the electron-emitting device having carbon and/or a carbon compound at the electron-emitting portion and/or near the electron-emitting portion without applying the first voltage to the anode.

22. A method according to claim 20, wherein, after the voltage application step is performed, without exposing the electron-emitting device to the atmosphere, the step of seal-bonding is performed.

23. A method according to claim 20, wherein the voltage application step is performed under a condition that a partial pressure of an organic substance in the region where the electron-emitting device exists is set at not more than $1\times10^{-6}$ Pa.

24. A method according to claim 20, wherein, in the voltage application step, a value of the voltage is larger than a normal driving voltage value applied to the electron-emitting device at an image display operation.

25. A method according to claim 20, wherein the voltage application step comprises the step of causing the electron-emitting device to emit an electron.

26. A method of manufacturing an image display apparatus comprising a first member having an electron-emitting device subjected to an activation process and a second member having a phosphor which is irradiated with an electron emitted from the electron-emitting device to emit light, said method comprising:

a step of seal-bonding the first and second members in a seal bonding chamber in which a vacuum atmosphere is realized, wherein before the step of seal-bonding, a voltage application step of applying a voltage to the electron-emitting device subjected to the activation process is performed, and further comprising a panel getter step performed between the voltage application step and the seal-bonding step.

27. A method of manufacturing an image display apparatus comprising a first member having an electron-emitting device subjected to an activation process and a second member having a phosphor which is irradiated with an electron emitted from the electron-emitting device to emit light, said method comprising:

a step of seal-bonding the first and second members in a seal bonding chamber in which a vacuum atmosphere is realized, wherein before the step of seal-bonding, a voltage application step of applying a voltage to the electron-emitting device subjected to the activation process is performed, and further comprising an electron beam cleaning step performed before the voltage application step.

28. A method of manufacturing an image display apparatus comprising a first member having an electron-emitting device and a second member having a phosphor which is irradiated with an electron emitted from the electron-emitting device to emit light and having an anode to which a first voltage higher than a second voltage applied to the electron-emitting device is applied, said method comprising the steps of:

seal-bonding the first and second members in a seal bonding chamber in which a vacuum atmosphere is realized; and before the step of seal-bonding, performing a voltage application step of applying, to the electron-emitting device, a voltage having a voltage value larger than a normal driving voltage value applied to the electron-emitting device at an image display operation without applying the first voltage to the anode.

29. A method of manufacturing an image display apparatus comprising a first member having an electron-emitting device and a second member having a phosphor which is irradiated with an electron emitted from the electron-emitting device to emit light, said method comprising:

the step of seal-bonding the first and second members in a seal bonding chamber in which a vacuum atmosphere is realized; and wherein, before the step of seal-bonding, the voltage application step of applying, to the electron-emitting device, a voltage having a voltage value larger than a normal driving voltage value applied to the electron-emitting device at an image display operation is performed, and further comprising a panel getter step performed between the voltage application step and the seal-bonding step.

30. A method of manufacturing an image display apparatus comprising a first member having an electron-emitting device and a second member having a phosphor which is irradiated with an electron emitted from the electron-emitting device to emit light, said method comprising:

the step of seal-bonding the first and second members in a seal bonding chamber in which a vacuum atmosphere is realized, wherein, before the step of seal-bonding, the voltage application step of applying, to the electron-emitting device, a voltage having a voltage value larger than a normal driving voltage value applied to the electron-emitting device at an image display operation is performed, and further comprising an electron beam cleaning step performed before the voltage application step voltage.

* * * * *

UNITED STATES PATENT AND TRADEMARK OFFICE

CERTIFICATE OF CORRECTION

PATENT NO. : 6,821,174 B2
DATED : November 23, 2004
INVENTOR(S) : Tetsuya Kaneko et al.

It is certified that error appears in the above-identified patent and that said Letters Patent is hereby corrected as shown below:

Column 6,
Line 32, “atmosphere” should read -- atmosphere. --.
Line 65, “the-voltage” should read -- the voltage --.

Column 18,
Line 8, “connected/boded” should read -- connected/bonded --.

Signed and Sealed this

Seventeenth Day of May, 2005

JON W. DUDAS
*Director of the United States Patent and Trademark Office*